US005331248A

United States Patent [19]

Kang

[11] Patent Number: 5,331,248

[45] Date of Patent: Jul. 19, 1994

[54] COOLING APPARATUS OF MAGNETRON

[75] Inventor: Seong T. Kang, Kyungki, Rep. of Korea

[73] Assignee: Goldstar Co., Ltd., Seoul, Rep. of Korea

[21] Appl. No.: 872,375

[22] Filed: Apr. 23, 1992

[30] Foreign Application Priority Data

May 3, 1991 [KR] Rep. of Korea ..... 91-7213

[51] Int. Cl.[5] ..... H01J 25/50

[52] U.S. Cl. ..... 315/39.51; 315/39.75; 313/24; 313/13

[58] Field of Search ..... 313/24, 13, 28, 45, 313/46; 315/39.51, 39.75, 39; 361/384, 383, 392; 123/41.6, 41.61, 41.62; 165/1.82; 362/218; 250/428, 429

[56] References Cited

U.S. PATENT DOCUMENTS 3,626,251 12/1971 Vigue ..... 361/384
4,142,091 2/1979 Biethan, Sr. ..... 361/384
4,794,304 12/1988 Ito ..... 315/39.51
5,087,853 2/1992 Oguro et al. ..... 313/45

FOREIGN PATENT DOCUMENTS 0093833 4/1987 Japan ..... 315/39.51

*Primary Examiner*—Donald J. Yusko
*Assistant Examiner*—Vip Patel
*Attorney, Agent, or Firm*—Morgan & Finnegan

[57] ABSTRACT

Disclosed is a cooling apparatus for a magnetron, comprising a channel-shaped heat radiation plate for dissipating the heat generated from the anode of a magnetron, a yoke for supporting the heat radiation plate, an opening formed in both side walls of the heat radiation plate, and a secondary air passage formed in both side walls of the yoke for passing cooling-air to the opening, whereby the main stream of the cooling-air coming through the forward end of the heat radiation plate is pushed towards the anode in the rear region of the anode by the cooling-air driven through the secondary passage and opening into the rear region.

6 Claims, 3 Drawing Sheets

COOLING APPARATUS OF MAGNETRON

FIELD OF THE INVENTION

The present invention concerns a magnetron, and more particularly an apparatus for cooling the anode of a magnetron which generates heat of high temperature.

TECHNICAL BACKGROUND

Generally, a magnetron used in an electronic appliance such as microwave oven, as shown in FIG. 1, comprises an anode 10 for generating microwaves as well as heat of high temperature, a plurality of heat radiation plates 11 mounted around the anode for dissipating the heat generated by the anode, a yoke 16 for enclosing the heat radiation plates, a seal 17 connected to the upper and lower ends of the anode, and a ring-shaped permanent magnet 18.

In such a conventional magnetron, when the anode is applied with a voltage, the motion of thermally generated electrons generates microwaves outputted through the output means 19, in which case a portion of the microwaves is dissipated in the form of heat. Namely, the heat of high temperature generated by the anode 10 is in part dissipated through the heat radiation plates 11 and in part through the seal 17 and permanent magnet 18, when a blowing fan (not shown) drives cooling-air into the gaps between the yoke and heat dissipation plates so as to prevent the temperature increase of the anode and the capability degradation of the permanent magnet. In this case, when the cooling-air flows through the inside of the heat radiation plates 11, the rear side of the anode 10 is not effectively cooled by the cooling-air compared to the front side because, as shown in FIG. 2, it is hardly possible to obtain uniform cooling of the anode.

In order to obtain uniform cooling of the anode there has been proposed a guide wall 15 provided on the heat radiation plates near the flange 12 for supporting the anode 10, as shown in FIG. 3, which is disclosed in U.S. Pat. No. 4,794,304. In this case, when the cooling-air is driven through the gaps between the heat radiation plates by a blowing fan, the pressure difference between the rear and front sides of the cylindrical anode causes the air-separation in the rear region of the anode to push the main stream of the cooling-air away from the rear side of the anode, Hence the cooling effect of the rear side of the anode is considerably worse than that of the front side, so that there occurs a temperature difference of a few ° C. to several tens of ° C. between the rear and front sides of the anode. This temperature difference degrades the output efficiency of the magnetron and adds thermal distortion of the anode, thus considerably reducing the effective life of the magnetron.

SUMMARY OF THE INVENTION

It is an object of the present invention to provide a cooling apparatus for a magnetron, wherein the cooling-air driven by a blowing fan flows surrounding the anode so as to considerably enhance the cooling effect of the anode, thus eliminating the temperature difference between the rear and front sides of the anode.

According to the present invention, a cooling apparatus for a magnetron comprises a heat radiation plate with a means for supporting the anode, a flow guide means provided on the heat radiation plate for guiding the cooling-air toward the anode, a yoke for enclosing the heat radiation plate, and an air passage means provided on both sides of the yoke for deviating the flow direction of the cooling-air driven into the heat radiation plate.

The present invention will now be described more specifically with reference to the drawings attached only by way of example.

BRIEF DESCRIPTION OF THE ATTACHED DRAWINGS

FIG. 1 is a schematic cross-sectional view of a conventional magnetron;

FIG. 2 schematically shows the flow lines of the cooling-air in the magnetron of FIG. 1;

FIG. 3 schematically shows the flow lines of the cooling-air in another conventional magnetron;

FIG. 4 is a perspective view for illustrating a heat radiation plate together with a yoke according to the present invention; and FIG. 5 schematically shows the flow lines of the cooling-air in the inventive structure,

DETAILED DESCRIPTION OF THE INVENTION

Figure 1:
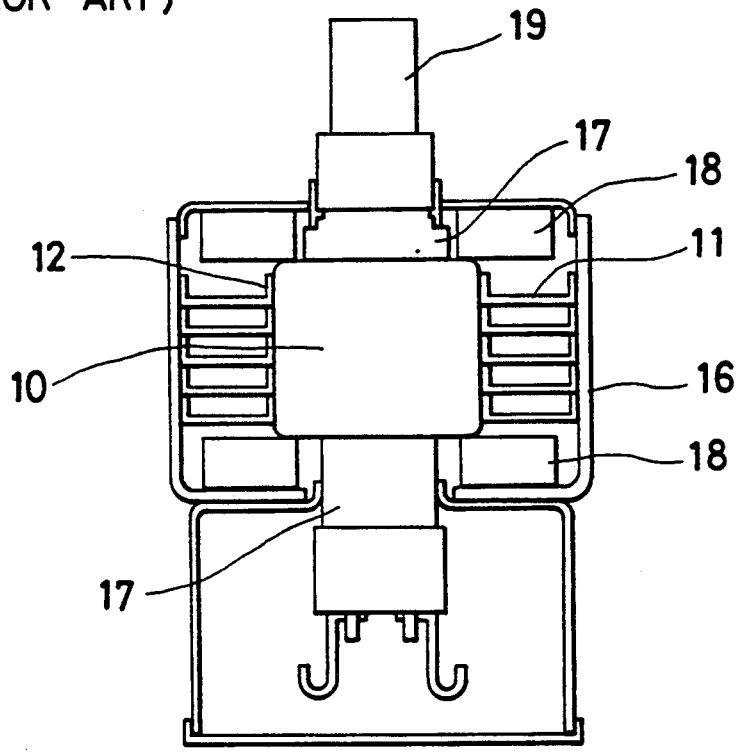
FIG. 1 (PRIOR ART)
Figure 2:
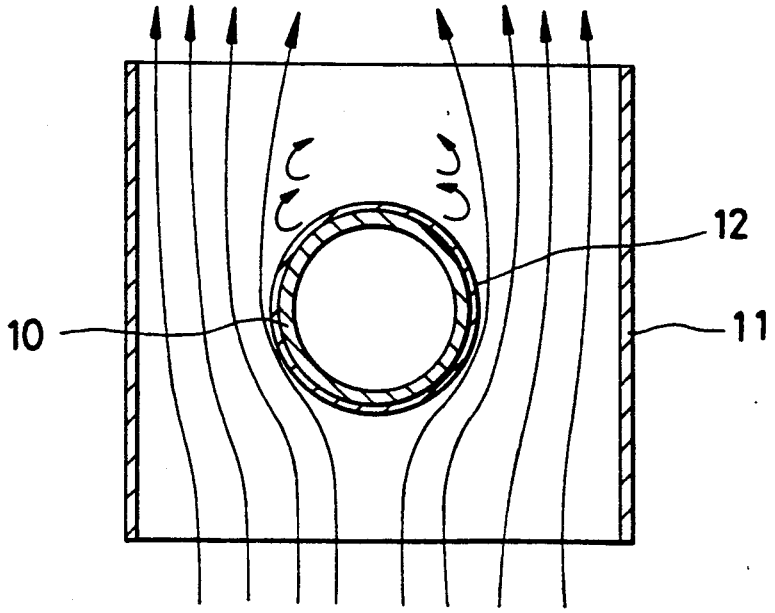
FIG. 2 (PRIOR ART)
Figure 3:
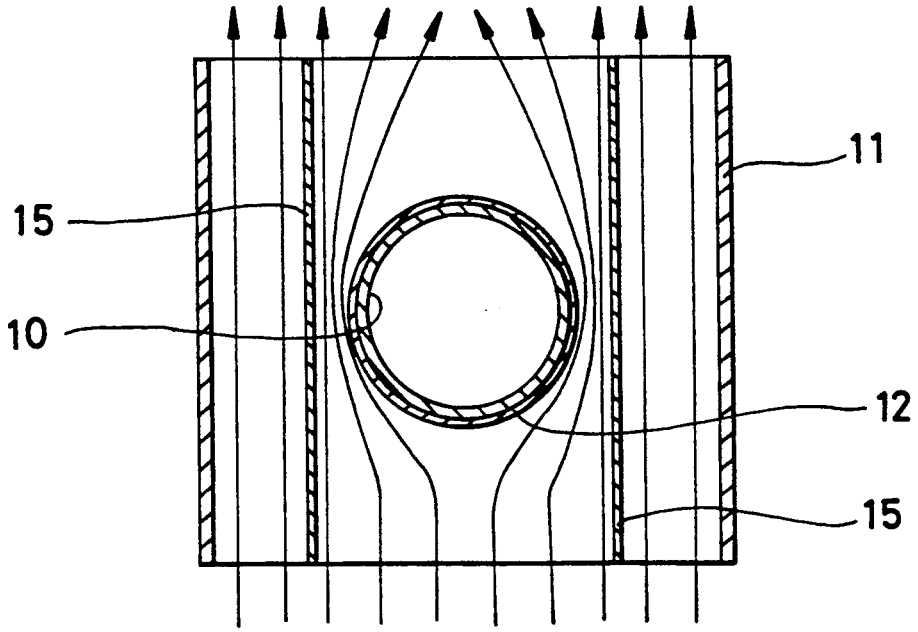
FIG. 3 (PRIOR ART)
Figure 4:
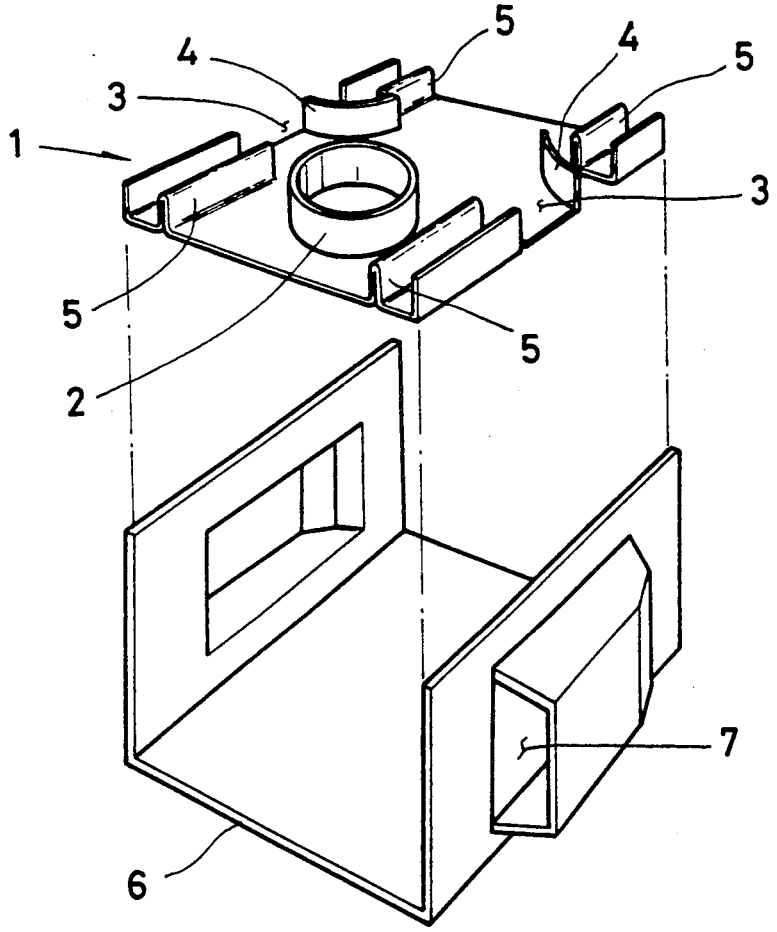
Figure 5:
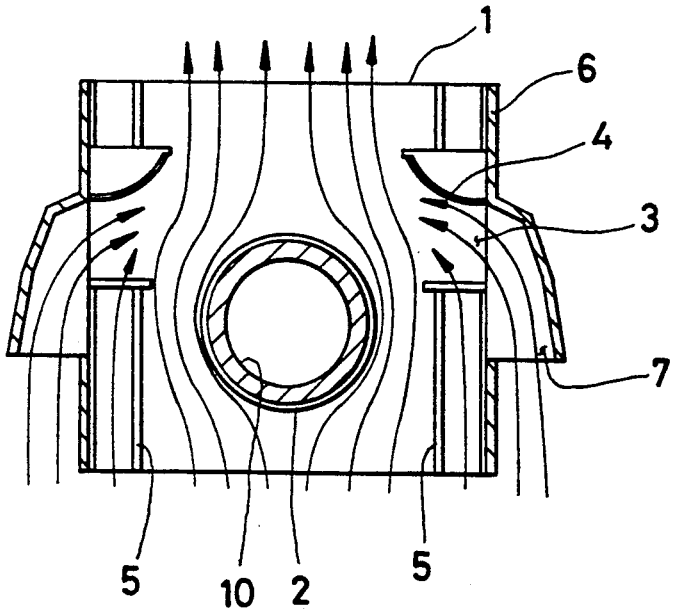

Referring to FIG. 4, a cooling apparatus of magnetron according to the present invention comprises a heat radiation plate with a guide means for guiding the cooling-air towards the anode, and a yoke member with an air passage means provided on both sides thereof for deviating the flow direction of the cooling-air driven into the heat radiation plate.

The heat radiation plate 1 has two side walls with an opening 3, which opening has a curved guide 4 for guiding the cooling-air towards the peripheral direction of the anode 10. There are also provided a pair of parallel vertically bent walls 5 inside the side walls for increasing the heat dissipation area, A ring-shaped flange 2 for supporting the anode 10 is formed on the forward part of the heat radiation plate 1. A secondary air passage 7 is provided in the form of a hopper in both side walls of the yoke 6 for passing cooling-air to the opening 3. Thus, the cooling-air coming through the secondary air passages 7 flows into the rear part of the heat radiation plate 1 guided by the curved guide 4 to the rear side of the anode 10.

Meanwhile, the cooling-air driven by a blowing fan into the heat radiation plate 1 is prevented from deviating outwardly from the anode by the vertically bent walls 5, thus increasing the heat radiation efficiency. And the main stream of the cooling-air coming through the forward end of the heat radiation plate 1 is pushed towards the anode 10 in the rear region of the anode by the cooling-air driven through the secondary passage 7 and opening 3 into the rear region, so that the air-flow separation is minimized.

Thus, the cooling-air driven into the heat radiation plate flows more effectively towards the anode by means of the vertically bent walls 5, and an addition cooling-air is driven through the secondary passage 7 into the rear part of the heat radiation plate, so that there is minimized the temperature difference between the front and rear sides of the anode, Furthermore, since the flange 2 for supporting the anode is provided in the front part of the heat radiation plate 1 as shown in FIG. 4, the heat dissipation area is considerably increased in the rear part rather than in the front part of the heat radiation plate, so that the cooling effect of the rear side of the anode is compensated in balance with the front side that is more easily cooled than the rear side.

As stated above, the inventive structure prevents the separation of the cooling-air behind the anode and minimize the temperature difference between the front and rear sides of the anode by means of the secondary air passage, so that the cooling efficiency of the magnetron is considerably enhanced, and the thermal distortion of the anode due to the temperature difference is prevented, thereby improving the performance and life of the magnetron.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims. The above references are hereby incorporated by reference.

What is claimed is:

1. A cooling apparatus of magnetron having an anode, comprising:

(a) a heat radiation plate having first and second sides with an anode supporting means for firmly supporting the anode;

(b) a flow guide means provided on said heat radiation plate for guiding cooling-air having a flow direction towards the anode;

(c) a yoke member having third and fourth sides for enclosing said heat radiation plate; and (d) an air passage means provided on the third and fourth sides of said yoke member for deviating the flow direction of the cooling-air driven from the third and fourth sides of said yoke member into the first and second sides of said heat radiation plate.

2. A cooling apparatus for a magnetron, comprising:

(a) a heat radiation plate with an anode supporting means for firmly supporting the anode;

(b) a flow guide means provided on said heat radiation plate for guiding cooling-air towards the anode;.

(c) a yoke member for enclosing said heat radiation plate; and (d) an air passage means provided on both sides of said yoke member for deviating the flow direction of the cooling-air driven into said heat radiation plate, wherein said flow guide means comprises:

(a) an opening provided in both side walls of said heat radiation plate for passing secondary cooling-air;

(b) a pair of parallel vertically bent walls provided on both sides of said anode supporting means for preventing the cooling-air passing said anode from diffusing away from said anode so as to guide the cooling-air towards the rear side of said anode.

3. A cooling apparatus for a magnetron as claimed in claim 1, wherein said anode supporting means is arranged in the forward part of said heat radiation plate so that heat dissipation area is considerably greater in the rear part of said heat radiation plate than in the front part.

4. A cooling apparatus for a magnetron, comprising:

(a) a heat radiation plate with an anode supporting means for firmly supporting the anode;

(b) a flow guide means provided on said heat radiation plate for guiding cooling-air towards the anode;

(c) a yoke member for enclosing said heat radiation plate; and (d) an air passage means provided on both sides of said yoke member for deviating the flow direction of the cooling-air driven into said heat radiation plate, wherein said air passage means is made in the form of an externally projected hopper communicating with said opening for passing secondary cooling-air.

5. A cooling apparatus for a magnetron as claimed in claim 2, wherein said opening for passing secondary cooling-air has a curved guide for guiding said secondary cooling-air towards the central portion of said heat radiation plate.

6. A cooling apparatus for a magnetron as claimed in claim 2, wherein said opening for passing said secondary cooling-air is arranged behind said anode supporting means.

* * * * *